US005431110A

United States Patent [19]

Adams, Jr.

[11] Patent Number: 5,431,110

[45] Date of Patent: Jul. 11, 1995

[54] TRUCK-TRAIN SYSTEM WITH LOCKING MECHANISM EMPLOYING A MOMENT ARM

[76] Inventor: George W. Adams, Jr., 3468 Sandpiper Ct., Hayward, Calif. 94542

[21] Appl. No.: 234,931

[22] Filed: Apr. 28, 1994

[51] Int. Cl.[6] ..... B61D 15/00

[52] U.S. Cl. ..... 105/4.1; 105/159; 410/45

[58] Field of Search ..... 105/4.1, 4.2, 4.4, 159, 105/168, 222; 410/45, 53, 90, 91

[56] References Cited

U.S. PATENT DOCUMENTS

| | | | |
|---|---|---|---|
| 2,513,552 | 7/1950 | Dove | 105/159 |
| 2,844,108 | 7/1958 | Madden | 105/159 |
| 2,963,986 | 12/1960 | Dobson | 105/159 |
| 4,653,966 | 3/1987 | Bakka et al. | 410/1 |
| 4,773,335 | 9/1988 | Smith et al. | 105/4.3 |
| 4,938,151 | 7/1990 | Viens | 105/4.3 |
| 5,020,445 | 6/1991 | Adams, Jr. | 105/4.1 |
| 5,107,772 | 4/1992 | Viens | 105/159 |
| 5,107,773 | 4/1992 | Daley et al. | 105/185 |
| 5,199,359 | 4/1993 | Bedard et al. | 105/168 |
| 5,291,835 | 3/1994 | Wicks | 105/159 X |
| 5,297,858 | 3/1994 | Zupan | 105/159 X |

FOREIGN PATENT DOCUMENTS

| | | | |
|---|---|---|---|
| 477115 | 3/1992 | European Pat. Off. | 105/159 |

*Primary Examiner*—Robert J. Oberleitner
*Assistant Examiner*—Kevin D. Rutherford
*Attorney, Agent, or Firm*—Schneck & McHugh

[57] ABSTRACT

A truck-train system that provides for the mounting and dismounting of a truck-trailer on/from a railway dolly at any stretch of train rails which is paved or gravelled level to the height of the rail head, and employing a moment arm reaction locking mechanism that automatically centers and engages the truck-trailer thereby locking it into place. The dolly includes a steering rod assembly that permits it to steer into curves in either direction of operation. Also included on the dolly, is a truck assembly that utilizes a floating pedestal. The moment arm reaction locking mechanism coupled with the steering rod assembly and the floating pedestal affords greater lateral stability and greatly increased operating speeds of the truck-train system.

16 Claims, 6 Drawing Sheets

TRUCK-TRAIN SYSTEM WITH LOCKING MECHANISM EMPLOYING A MOMENT ARM

DESCRIPTION

Technical Field

The present invention pertains to railway truck-train systems. Specifically, the present invention pertains to a simplified locking mechanism in a system for loading a truck-trailer onto a railway dolly or bogie.

Background Art

There are four main modes of transporting intermodal cargo: airfreight, shipping, railroad and trucking. Among the four modes, trucking is the most flexible because of its nearly unlimited access to origins and destinations of cargo. The flexibility of trucking makes it the most efficient mode of transporting cargo over short distances. This often results in the other three modes of transportation relying, to some extent, on trucking. However, long distance transportation of cargo between major metropolitan and manufacturing centers generally involve no advantage in flexibility, but do have relatively high fuel, labor and equipment costs.

To overcome these disadvantages, the railroads have employed many systems combining truck-trailers with railway cars. The first of these systems comprised of truck-trailers carried on railroad flat cars: the piggyback system. This method of shipping proved rapid, low cost and fuel efficient. It eliminated the need to load and unload the contents of the truck-trailer, while substantially reducing its wear. Soon recognized was the benefit of eliminating the flat car: reducing the weight moved over the train rails. Hence, the advent of the truck-train systems.

These truck-train systems reduce fuel consumption, track wear and capital investment. The truck-train systems generally comprise of a railway dolly or bogie interfacing between a truck-trailer and the railway system rails.

Prior art truck-train systems generally require special lifting equipment when connecting the truck-trailer to, or mounting it on, the railway dolly. One system as disclosed in U.S. Pat. No. 5,107,772 uses a railway bogie incorporating a platform and pivot pin adapted to connect to a truck-trailer. The platform is raised by a pneumatic system to couple it to the underside of the trailer.

U.S. Pat. No. 4,938,151 discloses another system that also mounts the trailer's wheels on a railway dolly, but connects the front end of the following truck-trailer directly to a special swivel fitting attached to the rear end of the front truck-trailer. A special lifting crane is necessary to mount the truck-trailers on the railway dollies and swivel fittings.

Another system, as disclosed in U.S. Pat. No. 4,653,966, uses a separate incline ramp to roll the trailer, on its wheels, onto one end of a first dolly to which the rear axle of the truck-trailer is attached. The trailer hitch end of the truck-trailer is then attached to a trailer hitch mounted on a pylon of a similar second railway dolly. If a separate incline ramp is not available at the destination, the trailers cannot be unloaded.

A further truck-train system, as disclosed in U.S. Pat. No. 2,844,108, mounts the truck-trailer's wheels on a mechanical platform, incorporated into one end of a railway dolly, with the trailer hitch end fitted to a trailer hitch attached to a mechanical platform on another railway dolly. The trailer is loaded and unloaded by moving the mechanical platforms laterally onto a paved area next to the railway tracks.

All truck-train systems of the prior art failed in their efforts by requiring additional equipment for their operation, such as separate lifting devices at each destination. This restricts the prior art truck-train systems to loading and unloading of truck-trailers at limited locations where this additional equipment is present.

Moreover, many of the prior art truck-train systems incorporate, in the railway dolly itself, special lifting devices, thus increasing the capital cost of the system and requiring continual maintenance. Many of these prior art truck-train systems require such special mechanical devices to overcome lateral instability of the truck-train systems.

SUMMARY OF THE INVENTION

The truck-train system of the present invention overcomes these problems with a two-axle railway dolly having two sets of parallel, spaced-apart horizontally planar surfaces, each of which define a ramp. Each ramp is located on opposite ends of the dolly and slopes upward terminating proximate the dolly's center. One ramp is adapted to engage the rear-wheel-end of a truck-trailer. The second ramp is adapted to engage a fifth- wheel-end of a truck-trailer and is elevated further from the rails than the first ramp therefor.

Between each pair of parallel, spaced-apart horizontally planar surfaces is a moment arm reaction locking mechanism. The moment arm reaction locking mechanism includes a receiver pin housing with a telescoping receiver pin extending upwardly therefrom; a jack to extend and retract the receiver pin; and two parallel, spaced-apart arms connecting to the top of the receiver pin housing that extend perpendicular away from the dolly's center. The arms each terminate in a connector end that has a recess. The moment arm reaction locking mechanism is pivotally mounted within the center sill of the dolly and normally biased so that the connector end is positioned against the frame and extends outward therefrom.

A truck-trailer with slidable tandem wheels is specially designed to operate with the dolly. The truck-trailer includes a first pair of parallel, spaced-apart rollers rotatably connected at the rear-wheel-end and a first receiver pin assembly attached thereto and centered between the first pair of rollers. Connected at the fifth-wheel-end is a second pair of parallel, spaced-apart rollers and a second receiver pin assembly centered between the second pair of rollers. A first pair of parallel, spaced apart locking plates are located proximate the rear-wheel-end so that the telescoping receiver pin and each recess of a moment arm reaction locking mechanism can automatically and simultaneously engage the first receiver assembly and each locking plate, respectively. A second pair of parallel, spaced apart locking plates are located proximate the fifth-wheel-end so that the telescoping receiver pin and the recess of a second moment arm reaction locking mechanism can automatically and simultaneously engage the first receiver assembly and each locking plate, respectively.

In operation, a truck-trailer is mounted onto the railway dolly at a loading area. A loading area may be any stretch of train rails which are paved or gravelled, level to the height of the rail head. Two dollies are set apart at intervals so that a tractor coupled to a truck-trailer may be positioned therebetween to load the truck-trailer onto a dolly. The trailer's tandem wheels are slid to the forward position. The trailer is then backed-up on the dolly so that the first pair of parallel, spaced-apart rollers engage the first ramp. As the trailer is backed-up, the ramp elevates it above the moment arm reaction locking mechanism. Upon reaching the top of the ramp, simultaneously, the receiver pin engages the receiver assembly and the moment arm reaction locking mechanism pivots to allow both connector ends to elevate and cooperatively engage each locking plate. The receiver pin is then manually forced into place by a scissor jack.

A second dolly is provided in front of the first dolly. A trailer is mounted on the second dolly in the manner provided above. The second dolly could be moved by a rail locomotive so that the trailer and dollies form a short train. Also, additional trailers and dollies may be connected together to form a train.

After securing the trailer to the second dolly, that dolly and the second trailer are backed up so that a second pair of parallel, spaced-apart rollers proximate the fifth-wheel-end of the first trailer engages the second ramp of the second dolly. The connector ends and locking plates; the receiver pin and receiver assembly are coupled in the manner provided immediately above. This procedure may be continued to couple together up to 95 trailers. After the last trailer is mounted, a dolly, coupled to a rail locomotive, is backed-up to the last truck-trailer mounted onto a dolly, the first truck-trailer in the train, and connected thereto in the manner provided above.

An air brake system is provided for the railway dollies, including an airline tat runs the length of each truck-trailer. The end, of the truck-trailer airline, is connected to the dolly closest to it. The truck-trailers may be disconnected by reversing the steps of the above-described procedure.

It is, therefore, an object of the present invention to provide an improved truck-train system by including a moment arm reaction locking mechanism that automatically centers and engages the truck-trailer, thereby locking the truck-trailer into place, and reducing truck-trailer's lateral instability.

It is a further object of the present invention to provide a modified railway dolly capable of operation at high speed in either direction while affording a smoother and more stable ride by having a truck assembly that supports the axle of a wheel-set with a free-floating pedestal, It is a further object of the present invention to provide a truck-train system in which the mounting and dismounting of truck-trailers can be performed by a standard truck-tractor or railway locomotive at any stretch of the train rails which is paved or gravelled, level to the height of the rail head and without using separate lifting devices, These and other objects of the present invention will become manifest upon review of the following detailed description when taken together with the drawings,

BEST MODE FOR CARRYING OUT THE INVENTION

Figure 1A:
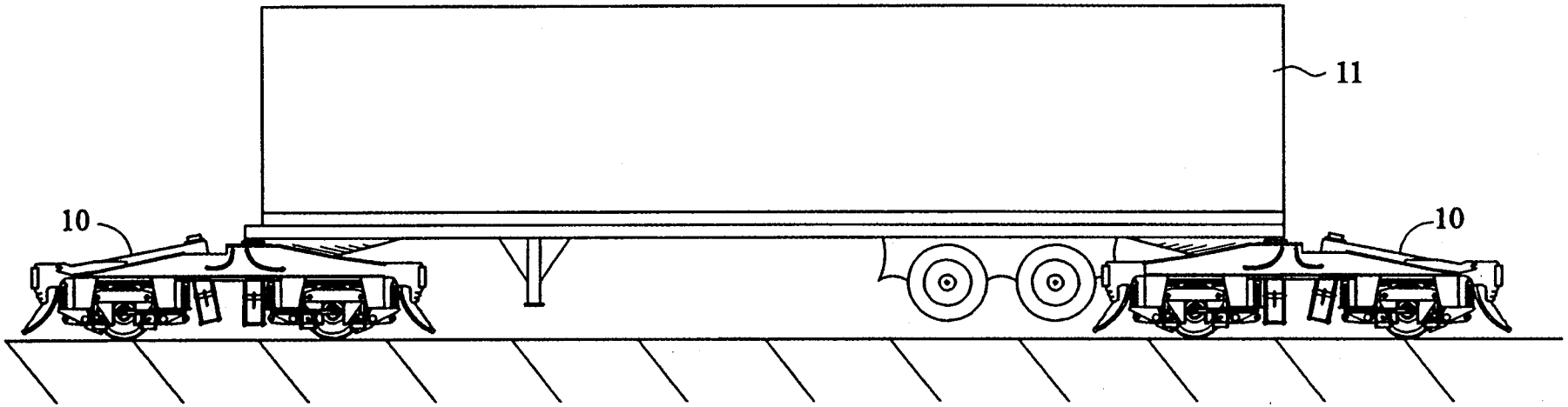
FIG. 1*a* is a side view of a single unit of the truck-train system.
Figure 1B:
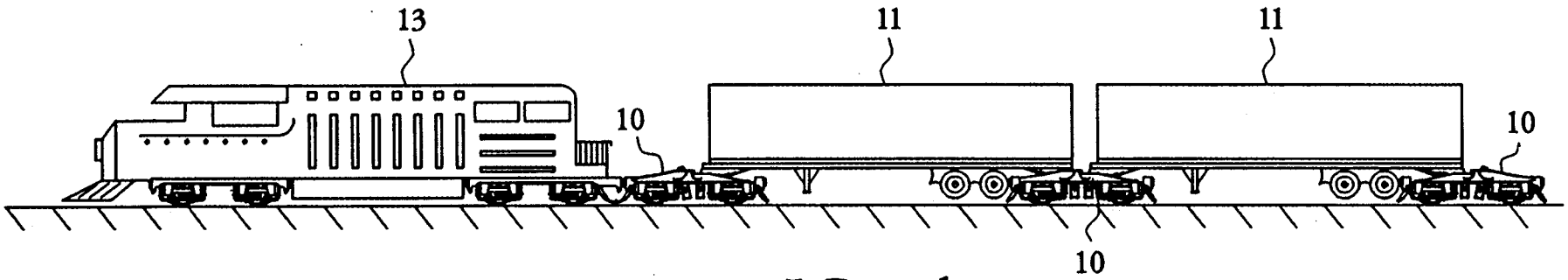
FIG. 1*b* is a side view of multiple units of the truck-train system connected to a railway engine.

Referring to FIG. 1*a*, shown therein is a single unit of the truck-train system including a first modified railway dolly 10, connected to the rear-wheel-end of a modified truck-trailer 11 and a second dolly 10 connected to the fifth-wheel-end of the truck-trailer 11. FIG. 1*b* shows multiple units of the truck-train system ready for transportation, wherein a train-engine 13 is connected to a third dolly 10 via a standard railway coupler, and that dolly 10 is the first unit of a truck-train system as it is connected to the fifth-wheel-end of a truck-trailer, the rear-wheel-end of which is connected to another dolly, as previously described.

Figure 2A:
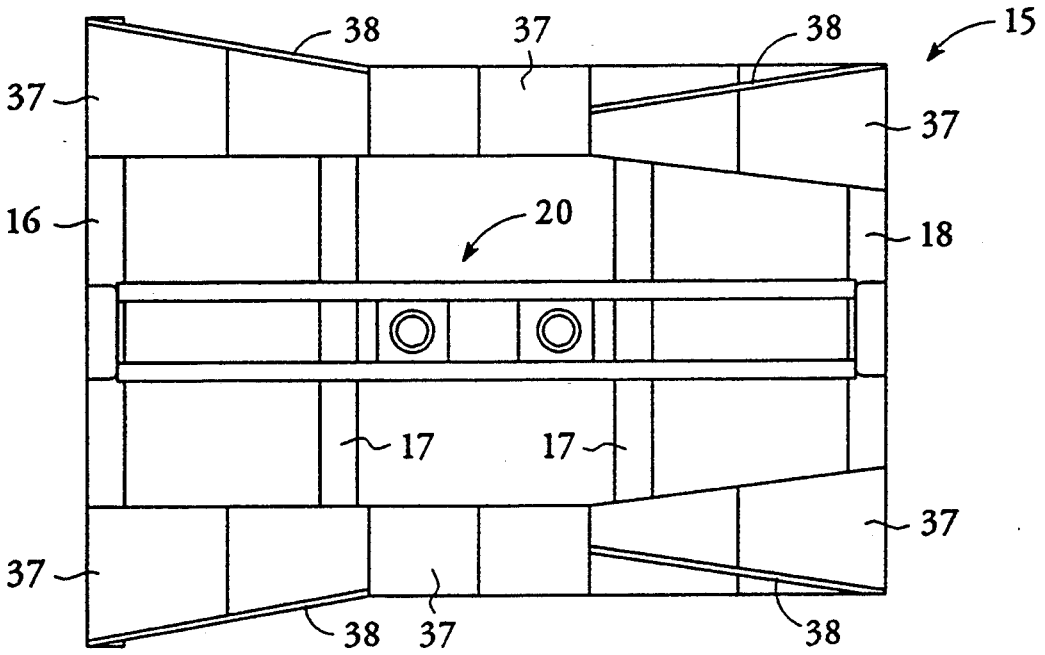
FIG. 2*a* is a top view of the frame of the railway dolly.

Referring to FIG. 2*a*, shown therein is the frame 15 of the dolly. The frame 15 includes four parallel, spaced-apart cross-members of equal length: a front cross-member 16, two center cross-members 17 and a rear cross-member 18. Attached to each side of the cross-members and extending from the first cross-member 16 to the rear cross-member 18, and perpendicular thereto, is a side member 19, more clearly seen in FIG. 2*b*. A center sill 20, having a length equal to that of the side members 19, is positioned equidistant therebetween and extends from the front cross-member 16 to the rear cross-member 18.

Figure 2B:
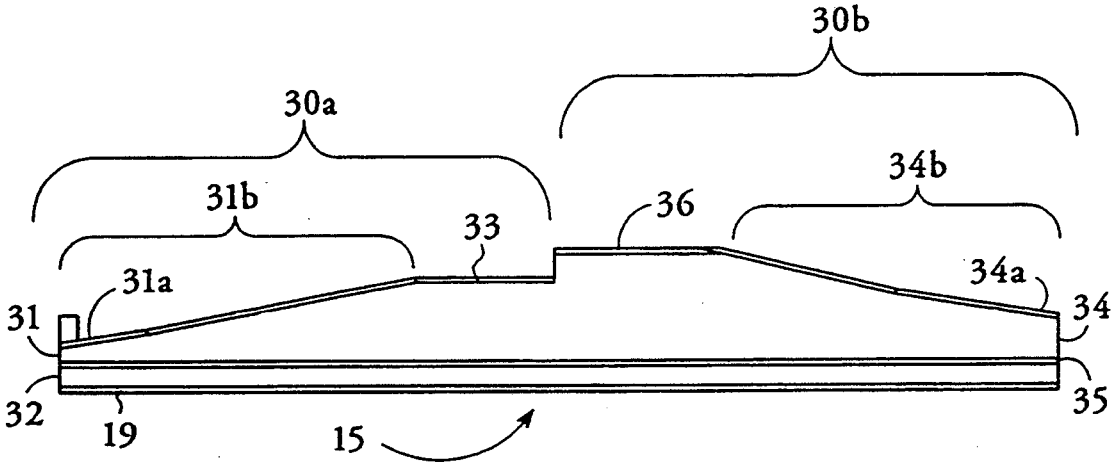
FIG. 2*b* is a side view of the frame of the railway dolly.

Referring to FIG. 2*b*, side-plates 30*a* and 30*b* are attached to each side member 19 and extend vertically upward therefrom, for elevating an end of a truck-trailer. The front edge 31 of plates 30*a* are aligned above the front edge 32 of the front cross-member 16 so that they each form a contiguous vertical plane that terminates in a top portion 31a. Plates 30*a* incline upward from the front edge 31 and terminate in a horizontally level surface 33, proximate the frame's 15 center. In the preferred embodiment, the inclined portion 31*b* is approximately 56.50" in length. The top portions 31*a* are of the appropriate height to engage rollers mounted on the rear-wheel-end of a truck-trailer. In the preferred embodiment, the top portion 31*a* would measure approximately 33.83" from the train rails. In the preferred embodiment, the horizontally level surface 33 is approximately 43.78" from the train rails and 22.875" in length.

The front edge 34 of plates 30*b* are aligned above the rear edge 35 of the rear cross-member 18 so that they each form a contiguous vertical plane that terminates in a top portion 34*a*. Plates 30*b* incline upward from the rear edge 35 and terminate in a horizontally level surface 36, proximate the center 15. In the preferred embodiment, the length of the inclined portion 34*b* and the horizontally level surface 36 are identical to that of plates 30*a*. However, the top portion 34*a* are of the appropriate height to engage the rollers mounted on the fifth-wheel-end of a truck-trailer, and have a greater height therefor. In the preferred embodiment, the top portion 34*a* and the horizontally level surface 36 measure approximately 42.38" and 52.33" respectively, from the train rails.

Attached atop the side plates 30*a* and 30*b* are top cover plates 37, seen more clearly in FIG. 2*a*, having a width sufficient to accommodate receiving a truck-trailer thereon. Included on the top cover plates 37 are roller guides 38.

Figure 2C:
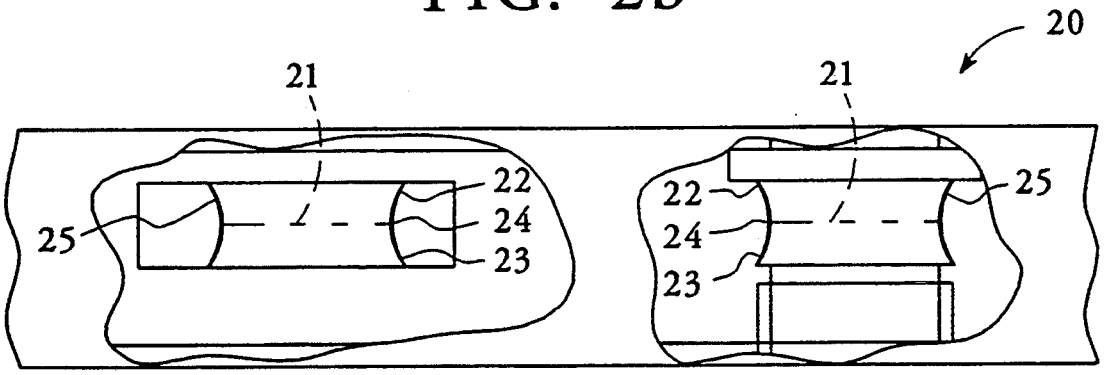
FIG. 2*c* is a detailed view of the center sill generally shown in FIG. 2*a*.

Referring to FIG. 2*c*, shown therein is the center sill 20, having two pivot ports 21, to receive the mechanism that fastens the truck-trailer to the dolly. In the preferred embodiment, the pivot ports 21 are centered on the center sill 20, each positioned approximately 14.375" from the center 15. Each pivot port 21 has an interior, including a top portion 22, a bottom portion 23 and a restricted diameter 24 centered between the top and bottom portions. The top portion 22 flares upwardly and outwardly from the restricted diameter 24. The bottom portion 23 flares outwardly and downwardly from the restricted diameter 24. Substantially matching the contour of the pivot port's 21 interior is a bearing surface 25.

Figure 3A:
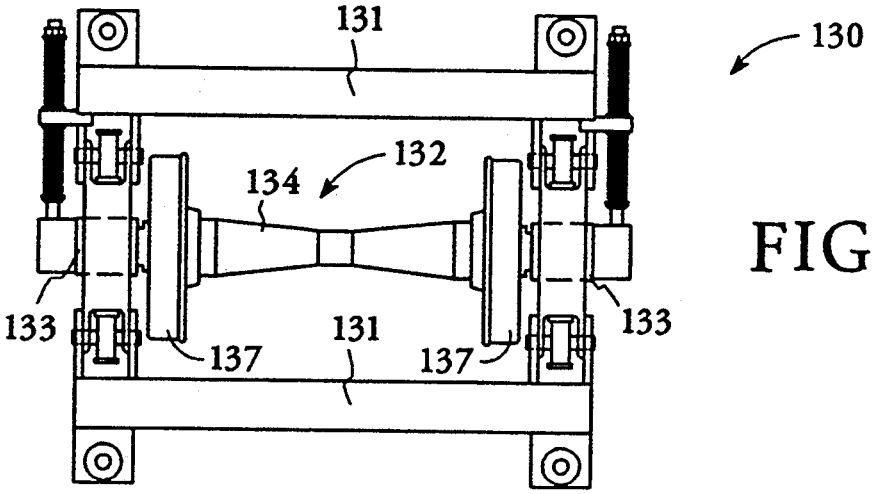
FIG. 3*a* s a top view of the truck assembly employing a floating pedestal.

Referring to FIG. 3*a*, shown therein is the truck assembly 130, including two parallel, spaced-apart frame attachments 131 and a standard 70 ton wheel-set 132 centered therebetween and coextensive therewith. The wheel-set 132 is comprised of 6"×11" bearings 133 connected at either end of the wheel-set axle 134, outside of the wheel 137. A floating pedestal is positioned at each end of the axle 134 and interfaces the wheel-set 132 with the frame attachments 131, thereby pivotally attaching the wheel-set 132 to the dolly frame.

Figure 3B:
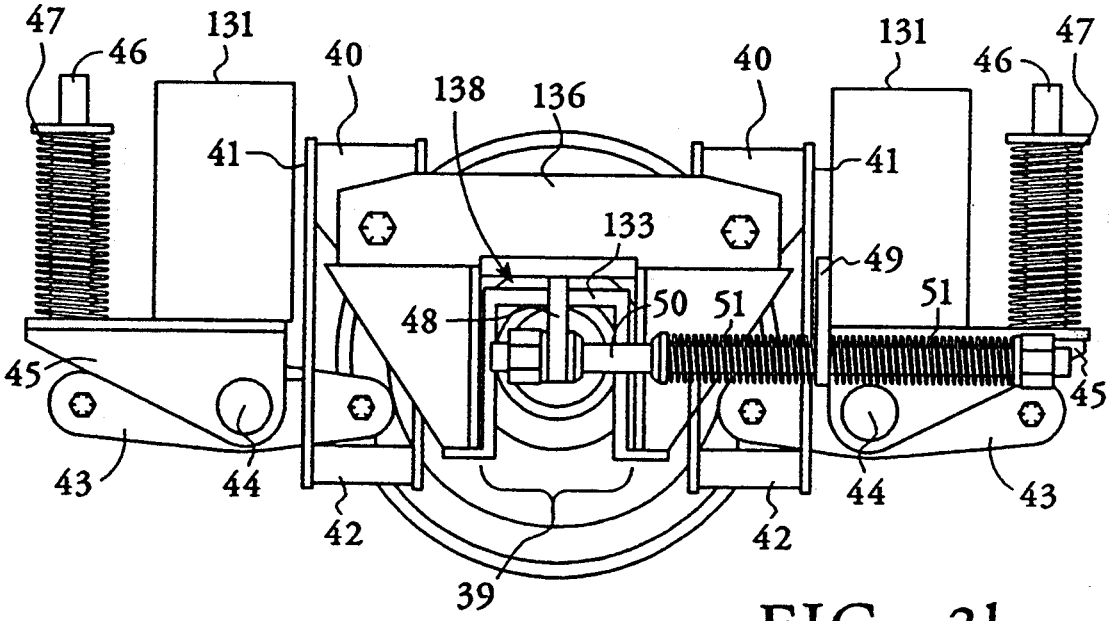
FIG. 3*b* s a side view of the truck assembly shown in FIG. 3*a*.

Referring to FIG. 3*b*, shown therein is the floating pedestal comprising an upper portion 136 centered above each bearing 133 and extending perpendicular between the frame attachments 131 so that its overall length is equivalent to the diameter of the wheel 137. The upper portion 136 extends vertically downward, defining a bearing channel 138 that terminates in an opening 139, below the bearing 133. The bearing channel 138 receives the bearing 133 therein. Pivotally attached to each end of the upper portion 136 is the upper terminus 40 of a swing hanger 41.

Each swing hanger 41 extends vertically downward with its lower terminus 42 pivotably attached to one side of a cam 43. The cam 43 is pivotably attached, at its center 44, to a lower member 45 of the frame attachment 131 and extends perpendicular thereto. The side of the cam 43 opposite the swing hanger 41 is pivotably attached to a rod 46 that extends vertically upward through the lower member 45. Resting on the lower member 45, is a spring assembly 47 positioned so that the rod 46 passes through the center of the spring assembly 47, and attaches to the top thereof.

On each side of the truck assembly 130, a steering rod assembly is provided. The steering rod assembly includes a first steering rod receiving member 48, attached to the upper portion 36 and extending vertically downward within the bearing channel 138; a second steering rod receiving member 49, attached to and extending beneath a frame attachment 31; and a spring assembly 51 with a steering rod 50 passing therethrough. One end of the steering rod 50 is rigidly attached to the first steering rod receiving member 48 and extends horizontally, perpendicular to the frame attachments 31, through the second steering rod receiving member 49, terminating in a bolt, positioned even with a rod 46 to secure the spring assembly 51 onto the steering rod 50.

Figure 3C:
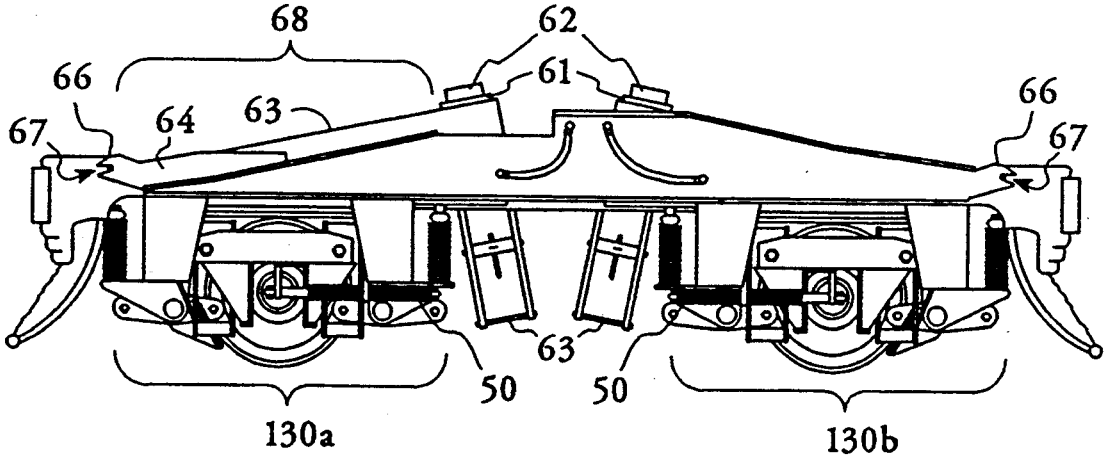
FIG. 3*c* s a side view of the railway dolly of the present invention.

Referring to FIG. 3*c*, two truck assemblies 30*a* and 30*b* are mounted on a dolly. The truck assemblies are mounted by any suitable means, e.g., arc welding, so that the frame attachments 131 connect to a cross member. The front truck assembly 130*a* has its frame attachments 131 rigidly connected to the front cross-member 16 and the adjacent center cross-member 17. The rear truck assembly 130*b* has its frame attachments 131 connected to the rear cross-member 18 and the adjacent center cross-member 17. The truck assemblies 30*a* and 30*b* are oriented so that the steering rods 50 face each other, proximate the center 15.

The steering rods 50 apply a constant longitudinal tension to the axles 134 and enable the dolly wheels to steer into curves, thereby providing a smoother and more stable ride. They are mounted on each truck 30 to permit the dolly to operate in either direction, e.g., forward or backwards. The floating pedestal also provides a smoother ride, because it is not rigidly attached to the dolly frame via the frame attachments 131. Rather, the pedestal floats above the bearings 133. This design provides a smoother ride by absorbing much of the shock transmitted by the wheel-set, into the pedestal's suspension, i.e., cams 43, swing hangers 41 and spring assemblies 47.

The swing hangers 41 were mounted in a vertical configuration to reduce the overall length of the dolly, while providing the desired[wheel-base. In the preferred embodiment, the wheel-base, as measured from axle-to-axle, is 106.75" in length.

Figure 4A:
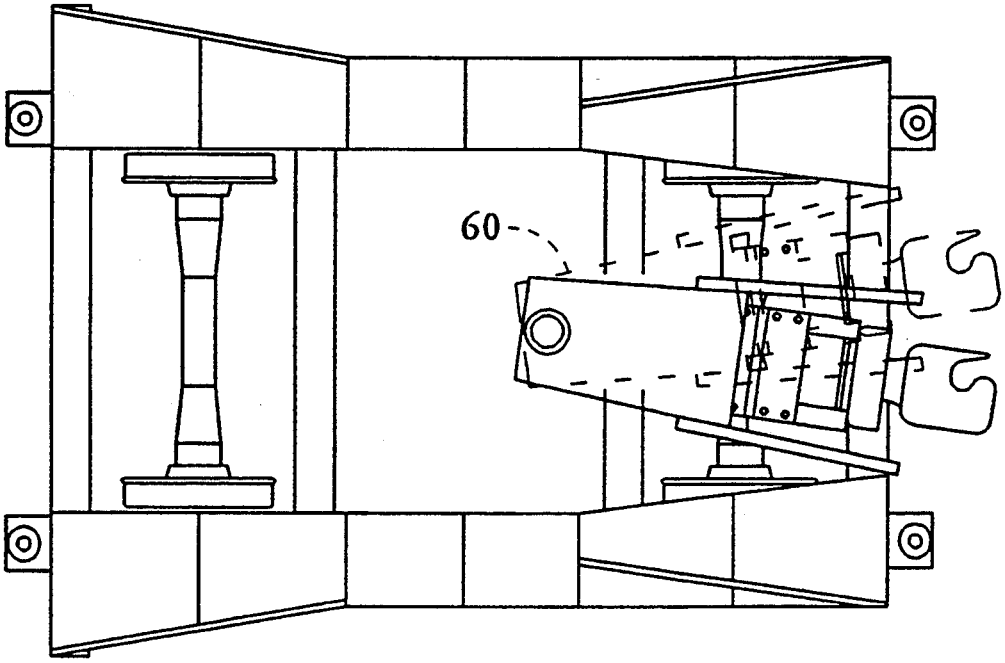
FIG. 4*a* is a top view of a moment arm reaction locking mechanism in accord with the present invention.
Figure 4B:
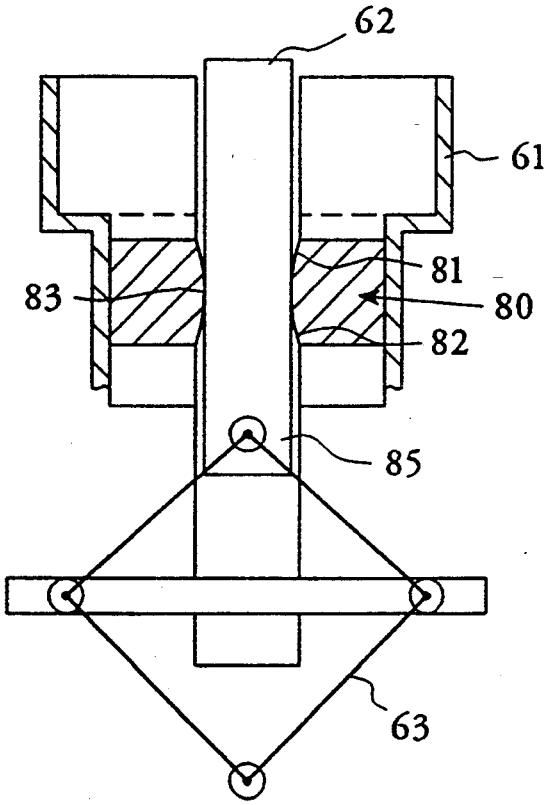
FIG. 4*b* is a detailed view of a receiver pin housing in accord with the present invention.
Figure 4C:
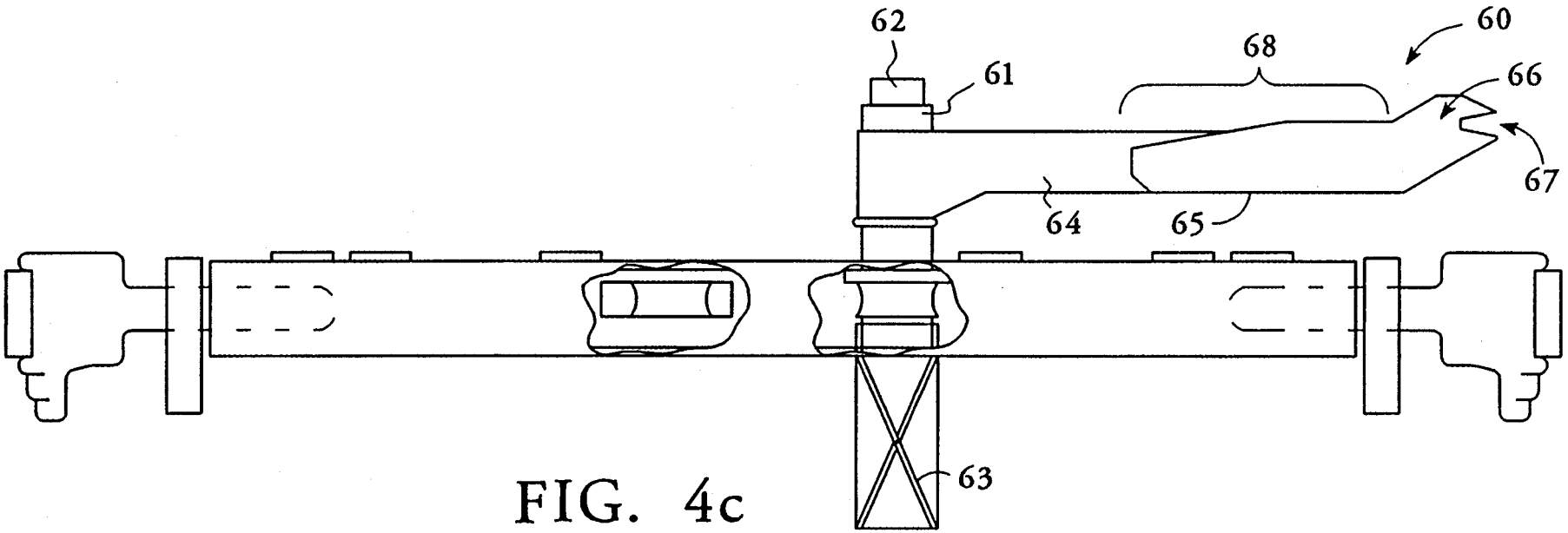
FIG. 4*c* is a side view of a moment arm reaction locking mechanism shown in FIG. 4*a* in accord with the present invention.

Referring to FIGS. 4*1* and 4*c*, shown therein is the moment arm reaction locking mechanism 60, which includes a cylindrical receiver pin housing 61, a spring biased cylindrical telescoping receiver pin 62 extending through the top of the receiver pin housing 61 and a scissor jack 63 mounted opposite said receiver pin 62. One side of a base-plate 64 is rigidly attached to the receiver pin housing and extends perpendicular therefrom. The base-plate 64 has connected thereto, opposite the side attached to the receiver pin housing, two parallel, spaced-apart arms 65 that extend further in the perpendicular direction. The arms terminate in a connector 66 that has a recess 67. The top of the arms and the base plate define a substantially flat planar surface 68. The side-to-side rotational movement of the moment arm reaction locking mechanism 60 is shown in FIG. 4*a*.

In the preferred embodiment, as shown in FIG. 3*c*, two moment arm reaction locking mechanisms 60 are attached to a dolly. Each is received in a pivot port 21. The arms 65 extend away from the center pin housing 61 so that connector 66 stretches beyond the side plates 30*a* or 30*b*. The moment arm reaction locking mechanisms are normally biased so that the connector 66 rests against a cross member 16 or 18.

FIG. 4*b* shows a detailed view of the receiver pin housing including a deflector block 80. The deflector block includes an upper portion 81, a lower portion 82 and a restricted diameter 83 centered therebetween. The upper portion 81 flares; upwardly and outwardly from the restricted diameter 83. The lower portion 82 flares downwardly and outwardly and terminates in an opening. The restricted diameter is of sufficient width to allow receiver pin 62 to pass therethrough. The upper and lower portions flare sufficiently to permit the receiver pin 62 to deflect approximately 7 degrees from the center of the deflector block. The lower end 85 of the receiver pin 62 is connected to scissor jack 63.

Figure 5:
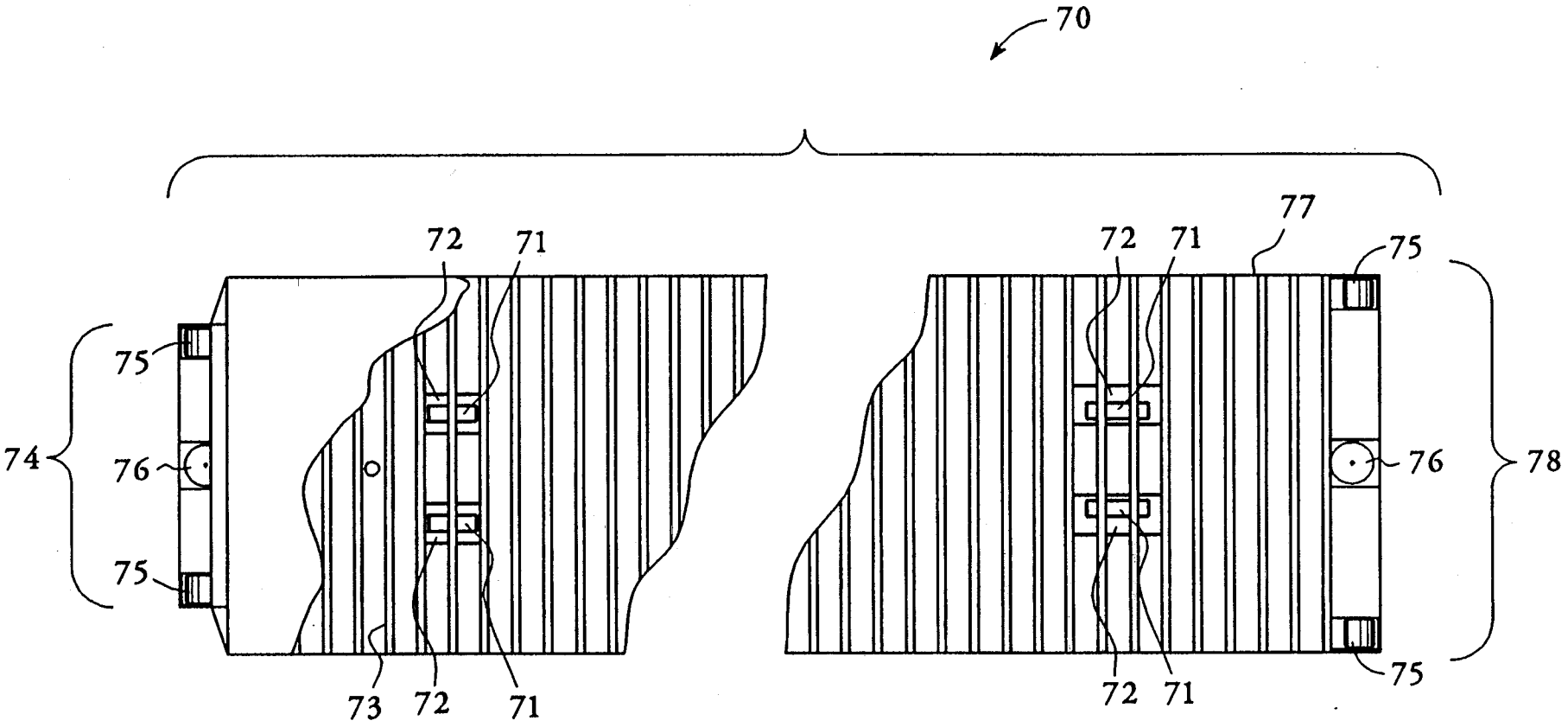
FIG. 5 is a bottom view of the truck-trailer.

Referring to FIG. 5, shown therein is a truck-trailer 70 having movable tandem wheels (not shown). On the underside of the truck-trailer 70 are provided two pairs of parallel, spaced-apart locking plates 71, each rigidly mounted within an aperture 72. The apertures 72 and locking plates 71 are positioned approximately equidistant from the truck-trailer's centerline. The locking plates 71 are mounted so that they do not interfere with either the operation of the tandem wheels or the king pin (not shown).

Extending from the front, or fifth-wheel-end 73 of the truck-trailer 70, and mounted thereto, is a first receiver cross-brace 74. The first receiver cross-brace 74 does not extend across the breadth of the truck-trailer 70. Rather, it is centered so that there is sufficient spacing on either side to permit a tractor to corner on surface streets, when the truck-trailer is attached thereto. Rollers 75 extend downward therefrom, and are rotatably mounted to, either side of the receiver cross-brace 74. Centered between the rollers is a receiver pin assembly 76.

A second receiver cross-brace 78 is mounted on the rear-wheel-end 77. Unlike the first receiver cross-brace, the second receiver cross-brace extends across the breadth of the truck-trailer 70. Rollers 75 are mounted on each side of the second receiver cross-brace 78. Centered on the second receiver cross-brace 78, between the rollers 75, is a receiver pin assembly 76. In the preferred embodiment, the rollers 75 are 8" in diameter. The parallel, spaced apart locking plates 71 and receiver pin assemblies 76 are positioned so that they can simultaneously engage a recess 67 of a moment arm reaction locking mechanism 60 and a telescoping receiver pin 62, respectively.

Figure 6:
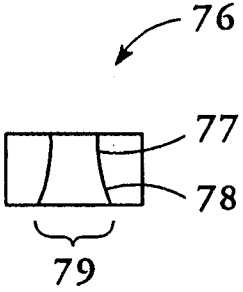
FIG. 6 is a detailed view of the receiver pin assembly shown in FIG. 5.

Referring to FIG. 6, shown therein is the receiver pin assembly 76. The receiver pin assembly includes a cylindrical upper portion 77 and a lower portion 78. The lower portion 78 flares downwardly and outwardly from the upper portion 77 and terminates in an opening 79. The lower portion 78 flares sufficiently to permit the receiver pin 62 to deflect approximately 7 degrees from the center of the receiver pin assembly 76. The upper portion prevents deflection of the receiver pin 62, once it is received therein.

I claim:

1. A truck-train system comprising:

a first and a second railway dolly, said dollies being in opposing relation and having a truck-trailer mounted therebetween, each said dolly having a center and a centerline, a means, mounted on each dolly, for raising an end of said truck-trailer above train rails, upon positioning said truck-trailer thereon, and means, pivotally attached to each dolly, for elevating a plurality of locking mechanisms onto said truck-trailer so that once said truck-trailer has reached a final seating position, said plurality of locking mechanisms automatically fasten thereto, said truck-trailer having a centerline and having means, proximate to each said end, for cooperatively engaging said elevating means thereby automatically aligning said centerline with the centerline of said truck-trailer.

2. A truck-train system as recited in claim 1 wherein each said dolly has two of said elevating means in opposing relation, each said elevating means including a top end and a bottom end, said top end having a first locking mechanism positioned proximate to said center, and two parallel, spaced-apart arms, extending away from said center, each said arm terminating in a second locking mechanism.

3. A truck-train system as recited in claim 2 wherein said elevating means includes a receiver pin housing extending between said top end and said bottom end, with a telescoping receiver pin extending upwardly from said top end, each said second locking mechanism including a recess.

4. A truck-train system as recited in claim 3 further including a means, connected to said bottom end, for extending and retracting said telescoping receiver pin.

5. A truck-train system as recited in claim 2 wherein said truck-trailer further includes a means, proximate to each end, for rotatably engaging said raising means.

6. A truck-train system as recited in claim 3 wherein said truck-trailer further includes:

a means, proximate to each said end, for rotatably engaging said raising means, an assembly, located proximate to each said end, for receiving said telescoping receiver pin, and a pair of parallel, spaced-apart locking plates, located proximate to each said end, to receive each said recess of said parallel, spaced-apart arms.

7. A truck-train system as recited in claim 1 wherein each said dolly includes a frame and two truck assemblies, each said truck assembly comprising:

an axle, two wheels located proximate to each end of said axle, means for pivotally mounting said axle to said frame, and means for maintaining a longitudinal tension between said frame and each said axle end.

8. A truck-train system comprising:

a first and a second railway dolly, said dollies being in opposing relationship and having a truck-trailer mounted therebetween, each said dolly having a center and a centerline, a means, mounted on each dolly, for raising an end of said truck-trailer above train rails, upon positioning said truck-trailer thereon, and means, pivotally attached to each dolly, for automatically elevating a plurality of locking mechanisms onto a truck-trailer so that once said truck-trailer has reached a final seating position, said plurality of locking mechanisms fasten thereto, said truck trailer having a centerline and having means, proximate to each said end, for cooperatively engaging said fastening means thereby automatically aligning said centerline with the centerline of said truck-trailer.

9. A truck-train system as recited in claim 8 wherein said elevating means further includes:

a top end and a bottom end, said top end having a first locking mechanism positioned proximate to said center, two parallel, spaced-apart arms extending in a direction away from said center, perpendicular therefrom, each said arm terminating in a second locking mechanism, a receiver pin housing extending between said top and bottom end, with a telescoping receiver pin extending upwardly from said top end, each said second locking mechanism including a recess, and a means, connected to said bottom end, for extending and retracting said telescoping receiver pin.

10. A truck-train system as recited in claim 9 wherein said truck-trailer further includes:

a means, proximate to each said end, for rotatably engaging said elevating means, an assembly, located proximate to each said end, to receive said telescoping receiver pin, and a pair of parallel, spaced-apart locking plates, located proximate to each said end, to receive each said recess of said parallel, spaced-apart arms.

11. A truck-train system as recited in claim 10 wherein each said dolly includes two truck assemblies, each said truck assembly comprising:

two parallel, spaced-apart frame attachments having ends, each said frame attachment including a lower portion proximate to each said end, an axle having two ends, centered between said spaced-apart frame attachments, said axle having two wheels located proximate to each said axle end, each said wheel having a diameter, two bearing boxes, each said bearing box being positioned at each said axle end, two floating pedestals for interfacing said axle with said frame attachment, each said floating pedestal located at each said axle end and having an upper portion with two end portions, each said upper portion being centered above said bearing and extending perpendicular between said frame attachment, defining a length, said length being equal with said diameter, said upper portion having a bearing channel for receiving said bearings, means for pivotally mounting each said end portion to said lower member, and two steering rod assemblies having opposite ends, each steering rod assembly having a coil spring and a rod received therein to apply a tension between said axle and said frame attachment, each said rod having one end connected to said upper portion, with said other end connected to said frame attachment, each said truck assembly being mounted to said frame so that each said pair of steering rod assemblies on said first truck assembly faces said pair of steering rods assemblies on said second truck assembly, proximate to the dolly center.

12. A truck-train system as recited in claim 8 wherein each said dolly includes a frame having lower members and two truck assemblies, each said truck assembly comprising:

an axle having two wheels located proximate to each end of said axle, each said wheel having a diameter, two bearing boxes, each said bearing box being positioned at each said axle end, two floating pedestals for interfacing said axle with said frame, each said floating pedestal located at each said axle end and having an upper portion with two end portions, each said upper portion being centered above said axle end, said upper portion having a channel for receiving said axle end, means for pivotally mounting each said floating pedestal to said lower members, and means for maintaining a tension between said frame and each said axle end.

13. A truck-train system comprising:

A first and a second railway dolly each having a frame with opposite ends and a center, a first cross-member being positioned at said first end, a second cross-member being positioned at said second end, a first ramp, having opposite sides, extending longitudinally upward from said first cross-member toward said second cross-member and terminating proximate said center, thereby defining a first recess between said sides, a second ramp, having opposite sides, extending longitudinally upward from said second cross-member toward said first cross-member and terminating proximate said center, thereby defining a second recess between said sides, and means, pivotally attached to each dolly, for elevating a plurality of locking mechanisms onto said truck-trailer so that once said truck-trailer has reached a final seating position, simultaneously said plurality of locking mechanisms are automatically fastened thereto, said truck-trailer having a centerline and having means, proximate to each said end, for cooperatively engaging said elevating means once said truck-trailer has reached a final seating position, thereby automatically aligning said centerline with the centerline of said truck-trailer.

14. A truck-train system as recited in claim 13 wherein said elevating means includes a receiver pin housing extending between said top end and said bottom end, with a telescoping receiver pin extending upwardly from said top end, each said second locking mechanism including a recess, and means, connected to said bottom end, for extending and retracting said telescoping receiver pin.

15. A truck-train system as recited in claim 14 wherein said truck-trailer further includes:

a means, proximate to each said end, for rotatably engaging one of said ramps, an assembly, located proximate to each said end, to receive said telescoping receiver pin, and a pair of parallel, spaced-apart locking plates, located proximate each said end, to receive each said recess.

16. A truck-train system as recited in claim 13 wherein each said dolly includes two truck assemblies, each said truck assembly comprising:

two parallel, spaced-apart frame attachments having ends, each said frame attachment including lower members proximate to each said end, an axle having two ends, centered between said spaced-apart frame attachments, said axle having two wheels located proximate to each said axle end, each said wheel having a diameter, two bearing boxes, each said bearing box being positioned at each said axle end, two floating pedestals for interfacing said axle with said frame attachments, each said floating pedestal located at each said axle end and having an upper portion with two end portions, each said upper portion being centered above said bearings, said upper portion having a bearing channel for receiving said bearings, means for pivotally mounting each said floating pedestal to said lower members, and means for maintaining a tension between said frame attachment and each said axle end.

* * * * *